United States Patent [19]

Hatz et al.

[11] 3,946,712

[45] Mar. 30, 1976

[54] INJECTION INTERNAL COMBUSTION ENGINE

[75] Inventors: Gottfried Hatz; Heinz Eibl, both of Ruhstorf, Germany

[73] Assignee: Motorengabrik Hatz KG., Ruhstorf, Germany

[22] Filed: July 25, 1974

[21] Appl. No.: 491,692

[30] Foreign Application Priority Data

Aug. 31, 1973 Germany ..... 2344002

[52] U.S. Cl. 123/139 AF; 123/139 AA; 123/139 R; 417/499

[51] Int. Cl.[2] ..... F02M 39/00

[58] Field of Search... 123/139 AF, 139 R, 139 AA; 417/499

[56] References Cited

UNITED STATES PATENTS

| | | | |
|---|---|---|---|
| 1,811,596 | 6/1931 | Salisbury | 123/139 R |
| 2,333,944 | 11/1943 | Lieberherr | 123/139 R |
| 2,612,840 | 10/1952 | Lasley | 417/499 |
| 2,612,841 | 10/1952 | Lasley | 417/499 |
| 2,821,926 | 2/1958 | Miller | 417/499 |
| 2,831,433 | 4/1958 | Siefert | 417/499 |
| 3,871,345 | 3/1975 | Hatz | 123/139 AF |

FOREIGN PATENTS OR APPLICATIONS

| | | | |
|---|---|---|---|
| 468,307 | 7/1937 | United Kingdom | 123/139 R |

*Primary Examiner*—Charles J. Myhre
*Assistant Examiner*—Daniel J. O'Connor
*Attorney, Agent, or Firm*—Woodhams, Blanchard and Flynn

[57] ABSTRACT

An improvement in an injection internal combustion engine having at least one fuel injection pump therein which is connected to the fuel supply tank through a suction conduit having a check valve connected in circuit therewith. Fuel which is not injected into the internal combustion engine is returned to the supply tank through another check valve located in a separate conduit from the suction conduit. The check valve in the separate conduit, when it is in its seated position, permits a small flow of fuel between the injection pump and the separate conduit.

6 Claims, 4 Drawing Figures

INJECTION INTERNAL COMBUSTION ENGINE

FIELD OF THE INVENTION

This invention relates to an injection internal combustion engine having at least one fuel injection pump which is connected to a fuel supply container through a suction conduit provided with a non-return valve, and in which fuel in excess of that used in an injection is conducted back to the supply container through a return flow conduit separately from the suction conduit and likewise including a non-return valve therein.

BACKGROUND OF THE INVENTION

In known arrangements of this kind, use is generally made of a fuel feed pump driven by the engine and this delivers the fuel from the supply container to the suction chamber of the injection pump during an operation thereof. These arrangements have the disadvantage that an additional unit, namely the feed pump, must be assembled and installed on the engine and, in addition, the drive to this feed pump has to be performed through additional drive transmitting means.

In order to avoid this drawback, in some known constructions, the fuel container has been arranged above the injection pump so that fuel can flow to the latter under gravity only. This makes a fuel feed pump in the suction conduit superfluous. This arrangement has, however, the disadvantage that when the supply container is installed in the engine, the gravity feed arrangement must be at a minimum elevation to ensure an adequate fuel feed to the injection pump. This involves consequent restrictions detrimentally affecting the capacity of the supply container and/or the overall size of the engine. It has also been proposed to provide a non-return valve in each of the suction conduit and return flow conduit of the fuel system, to enable the injection pump itself to act as the fuel feed pump and to be able to draw the fuel from the supply containers located therebelow. These constructions, however, have the disadvantage that, in consequence of the arrangement of the fully closing non-return valve being located above the injection pump, associated with the return flow conduit in that part of the return flow conduit which lies above the non-return valve, a fuel column may be set up which under certain conditions will very seriously obstruct the proper functioning of the system. For example, after an inadvertent emptying of the fuel supply tank, the conduit system will no longer be automatically evacuated of air because the fuel column which remains static in the return flow conduit above the non-return valve will prevent the escape of air during a fresh filling of the tank.

It is an object of the present invention to avoid these drawbacks in the known constructions and to provide an arrangement in which the operation of the injection pump itself can be relied on to draw the fuel from the supply tank without any constructional or functional limitations. This object is met in the present invention by the fact that a fully-closing non-return valve is incorporated in the suction conduit and that the non-return valve provided in the return flow conduit is of a construction such that when it is in its seated position, it permits a small flow of fuel between the return flow conduit and the injection pump.

Where using supply containers in which the lowermost part of the supply container is located below the injection pump and a manually operable auxiliary pump is provided in the suction conduit for filling the empty conduit system of the injection pump with fuel, in accordance with a special feature of the invention, the non-return valve associated with the suction conduit is installed in the auxiliary pump.

In systems of this character which have a fuel filter in the suction conduit, a very useful arrangement is acquired if the non-return valve, the auxiliary pump, and the filter are combined into a common unit.

In the case of injection combustion engines having a supply tank with a filling opening which is disposed above the injection pump, a simple and preferred embodiment of the invention resides in the arrangement whereby the non-return valve provided in the return flow conduit is arranged in such a way that it is disposed slightly below the filling part of the supply container.

BRIEF DESCRIPTION OF THE DRAWINGS

Examples of the embodiment of the invention will now be described with reference to the accompanying drawings, in which.

SUMMARY OF THE INVENTION

An improvement in an injection internal combustion engine having at least one fuel injection pump which is connected to the fuel supply tank through a suction conduit having a non-return valve connected in circuit therewith, and in which fuel in excess of that used in an injection is conducted back to the supply tank through a return flow conduit separately from the suction conduit and likewise including a non-return valve therein. A fully closing non-return valve is connected in the suction conduit and the non-return valve connected in the return flow conduit has the characteristic such that when it is in its seated position, it permits a small flow of fuel between the return flow conduit and the injection pump.

DETAILED DESCRIPTION

Figures 1, 2:
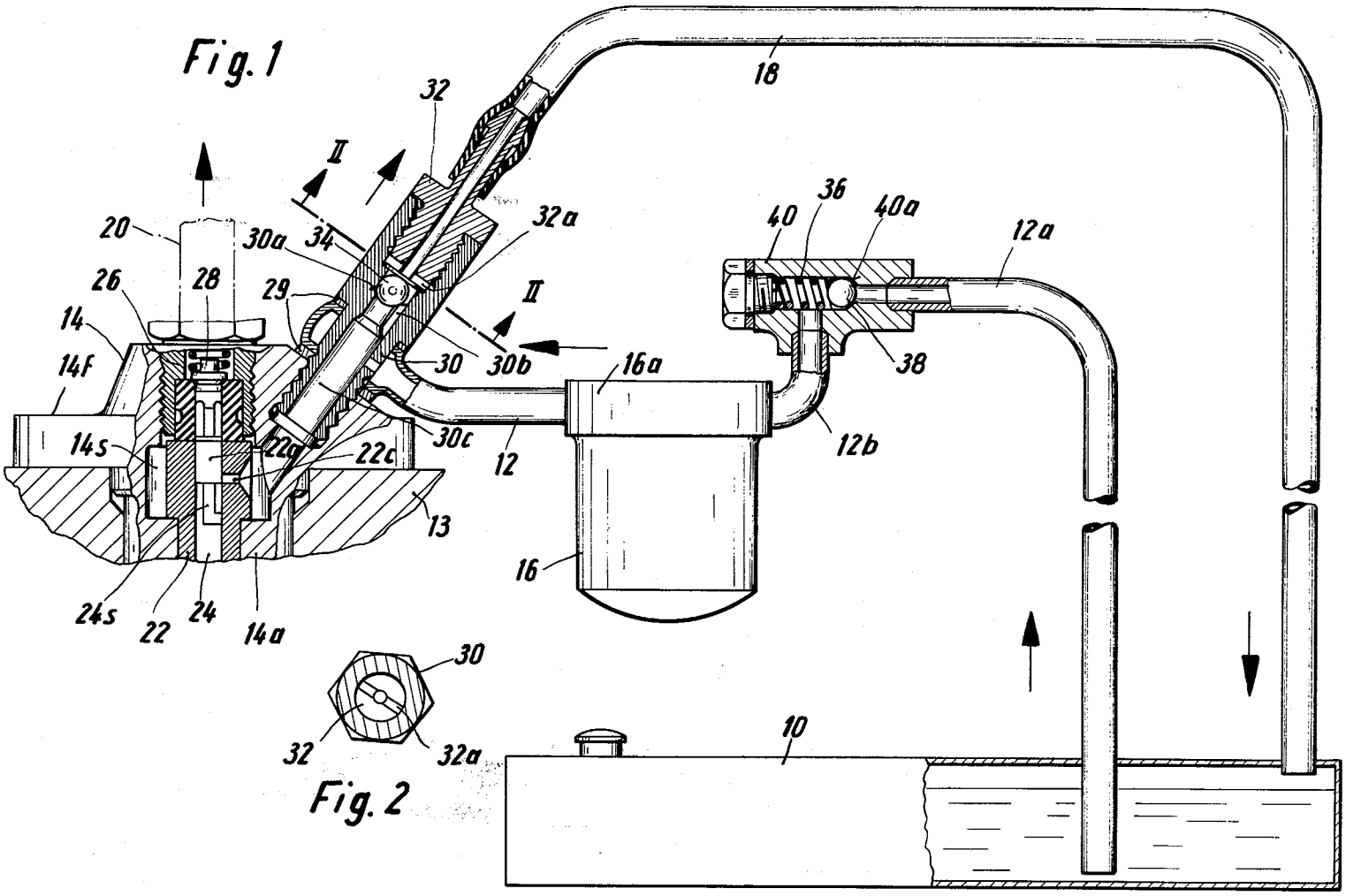
FIG. 1 is a diagrammatic illustration, partly in section, of the fuel system of an injection pump embodying the invention.
FIG. 2 is a sectional detail taken along the line II—II of FIG. 1.

In the apparatus illustrated in FIG. 1, fuel passes from a fuel reservoir 10 through a suction conduit 12,12*a* to an injection pump 14, passing through a fuel filter 16 of known type. The fuel reservoir 10 as a whole is disposed at a level lower than the injection pump 14. The excess fuel which is not injected is returned to the reservoir 10 through a return flow conduit 18 in a manner which will be described in more detail below. The injection pump 14 forwards a shot of fuel to injected through a compression conduit 20 to an injection nozzle (not shown) of the internal combustion engine. The injection pump 14, illustrated in this example is a known so-called insertion pump, in which the downwardly projecting body 14*a* thereof supports a hollow bushing 22 for a pump piston 24 movable longitudinally therein. When the lower part 14*a* of the pump 14 is inserted in a casing 13 of the internal combustion engine, it is fastened by means of a flange 14*f* equipped with two holes which receive fastening screws (not shown) therein. The piston 24 is driven upwardly from below by a cam and is moved in the opposite direction, i.e. downwardly, by a return spring (not shown). Disposed above the hollow piston bushing 22 is a screw-threaded insert 26 having a spring pressed valve element 28 therein. Fuel passes through this valve into the compression conduit 20.

The inflow conduit 12 is in fluid communication with an annular suction chamber 14*s* in the pump 14. Fuel passes from the suction chamber 14*s* through a duct 22*s* in the piston bushing 22 into an operating chamber 22*a* in the hollow bushing. The fuel is drawn from the suction chamber 14*s* in response to a downward movement of piston 24, and during the upward movement of the piston, a part of this indrawn fuel flows back from the operating chamber 22*a* into the suction chamber 14*s* until the upper edge of piston 24 completely covers and closes the duct 22*s*. The effective delivery stroke of the piston 24 now begins and continues until a control groove 24*s* on the periphery of the piston 24 reestablishes a connection between the operating chamber 22*a* and the return flow duct 22*s* and permits a renewed return flow of the fuel until the end of the piston stroke. In this way, only a minor part (approximately one-sixteenth to ¼ depending on the quantity setting and the speed) of the total amount of fuel drawn in by the piston 24 passes to the injection nozzle, the maximum remainder of the fuel being forcibly returned back.

The suction conduit 12 is connected to the injection pump 14 by means of a hollow connecton nipple 30, with the interposition of sealing rings 29. A hollow element 32 connected to the return flow conduit 18 is screwed into a threaded recess in the nipple and the element 32 simultaneously serves as a stop to limit the movement of a ball valve which is disposed within the nipple 30. The seat 30*a* on the nipple 30 for a ball valve 34 is interrupted by a groove 30*b* whereby there is a small aperture for flow between the conduit 18 and the chamber 30*c* within the nipple 30 even when the ball valve 34 is on its seat in the valve-closed condition. A transverse groove 32*a* (FIG. 2) is provided above the ball valve 34 in the end of the hollow element 32 which acts as an abutment, and this cross groove ensures a full flow connection between the inner chamber 30*c* and the return flow conduit 18 when the ball valve 34 is in contact with the abutment element 32.

Arranged in the suction conduit 12 adjacent the filter 16 is a non-return valve constituted by a fully-closing ball valve 38 which is biassed by a spring 36 against a seat 40*a* in the body 40 of this valve. A flow connection between the valve 38 on the one hand and the filter 16 and the conduit 12 on the other is made by a short connecting piece 12*b*.

OPERATION

The apparatus described operates as follows:

Let it be assumed that the tank and the complete conduit system, including the injection pump, are filled with fuel. When piston 24 of the injection pump 14 performs a suction stroke, the non-return valve 38 opens under the suction effect and fuel is drawn from the reservoir or tank 10 by the piston of the injection pump itself and, consequently, fuel will flow into the suction chamber 14*s*. When the piston 24 performs a delivery stroke, the valve 38 re-closes under the excess pressure from the injection pump 14 and the spring 36 so that a column of fuel in the part 12 of the suction conduit between the injection pump 14 and the valve

38 cannot flow back to the tank 10 during the delivery stroke, but remains static in the part 12. During the next suction stroke of the pump 14, which follows the delivery stroke just described, the column of fuel in the part 12 has only to be impelled from the static condition thus avoiding any counterflow movements of the fuel column in the part 12 during an operation of the pump. The excess fuel not injected into the conduit 20 flows back through the valve 34, which is fully opened during the return flow phase, and through the return flow conduit 18 into tank 10. As a consequence of this advantageous arrangement of the fluid circuitry and the valves of the injection system, the required fuel is drawn in by the injection pump itself from a supply container which, if required, can be located up to two meters lower than the injection pump itself and, for example, can be arranged entirely below ground.

Figure 3:
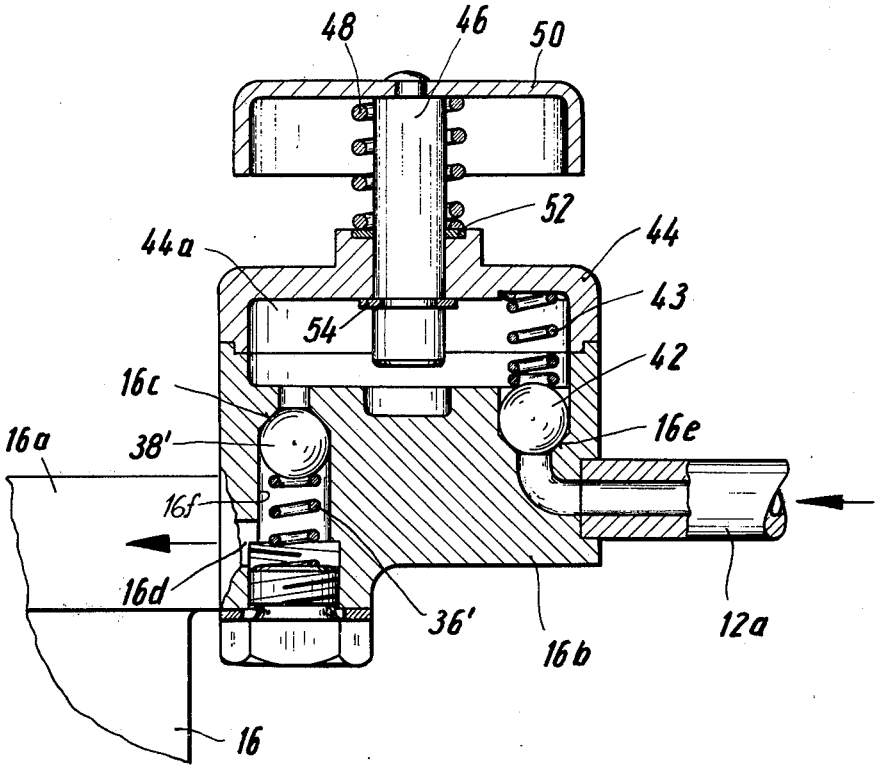
FIG. 3 is an auxiliary fuel pump illustrated in a larger scale.

Each fuel injection system must be evacuated of air before it is set into operation, that is to say, must be so completely charged with fuel that air is expelled completely from within the system. The system illustrated in FIGS. 1 and 2 may for example be vented of air, when the tank 10 is full, by unscrewing the element 32, removing the ball valve 34 and filling the internal chamber 30*c* completely with fuel from the exterior until any quantity of air in the system escapes at the filling point, where the excess fuel overflows. In order to avoid this somewhat troublesome venting operation, it is not known in the case of injection pump systems to effect the venting and filling of the system with fuel directly from the tank by arranging a manually-operable auxiliary pump in the suction conduit. The illustration in FIG. 3 shows an auxiliary pump of this nature mounted on the cover 16*a* of filter 16 and the non-return valve described in connection with the first embodiment above is arranged in the suction conduit as an operating valve in this auxiliary pump. (The injection pump 14 and the return flow conduit 18 and valve 34 are used in the same way as in FIGS. 1 and 2.) The lower part 16*b* of the auxiliary pump is secured to the cover 16*a* of the filter 16 by some convenient method which is not illustrated in detail, for example by a threaded connection, and has a recess 16*f* therein which receives the ball valve 38′ and a biassing spring 36′. The seat for the ball valve 38′ is designated 16*c*. A passageway 16*d* provides communication from the recess 16*f* to the interior of the filter 16. A further ball valve 42 having a return spring 43 is provided at the suction side of the auxiliary pump and the seat of this ball is designated 16*e*. The part 12*a* of the suction conduit is connected in fluid circuit with the valve seat 16*e*. Arranged in the upper part 44 of the auxiliary pump is a piston 46, the return spring 48 of which is mounted between a manually-operable press cap 50 and a sealing ring 52. The upper static position of the piston 46 is limited by a spring ring 54.

First filling of the system is brought about by depressing the piston 46 by manually pressing on cap 50. During the upward return movement of the piston, fuel is drawn from tank 10 into the conduit 12*a* and into the inner chamber 44*a* of the auxiliary pump through the valve 42 which has thereby been opened. During the next depression of the auxiliary piston 46 and the valve 42 closes and the valve 38′ opens so that the fuel is delivered by the auxiliary piston 46 from the inner chamber 44*a* through the filter 16 to the conduit system of the injection pump 14. A manual operation of the auxiliary piston 46 is continued until the complete fluid circuit in the system is filled with fuel and all air has been expelled from the system through the valve 34, which valve 34 opens during the pressure stroke of the piston 46, into the tank 10. (During an evacuation of air and a charging with fuel, the injection pump 14 is immobile.) During the operation of the injection pump 14, the piston 46 of the auxiliary pump remains in its upper static position illustrated in the drawing. The piston 24 of the pump 14 draws fuel from the tank 10 through the conduit system 12*a*, 44*a*, 12, into the suction chamber 14*s* of the injection pump, the valves 38' and 42 being opened during the suction stroke. When the piston 24 performs a compression stroke, the valve 38' closes and by this means takes over the above described function of the non-return valve 38 in the suction conduit. The action of the injection pump 14 and the remainder of the conduit system in FIG. 3 is the same during the operation as in the case of the construction illustrated in FIGS. 1 and 2, so that there is no need to repeat the description of this.

Figure 4:
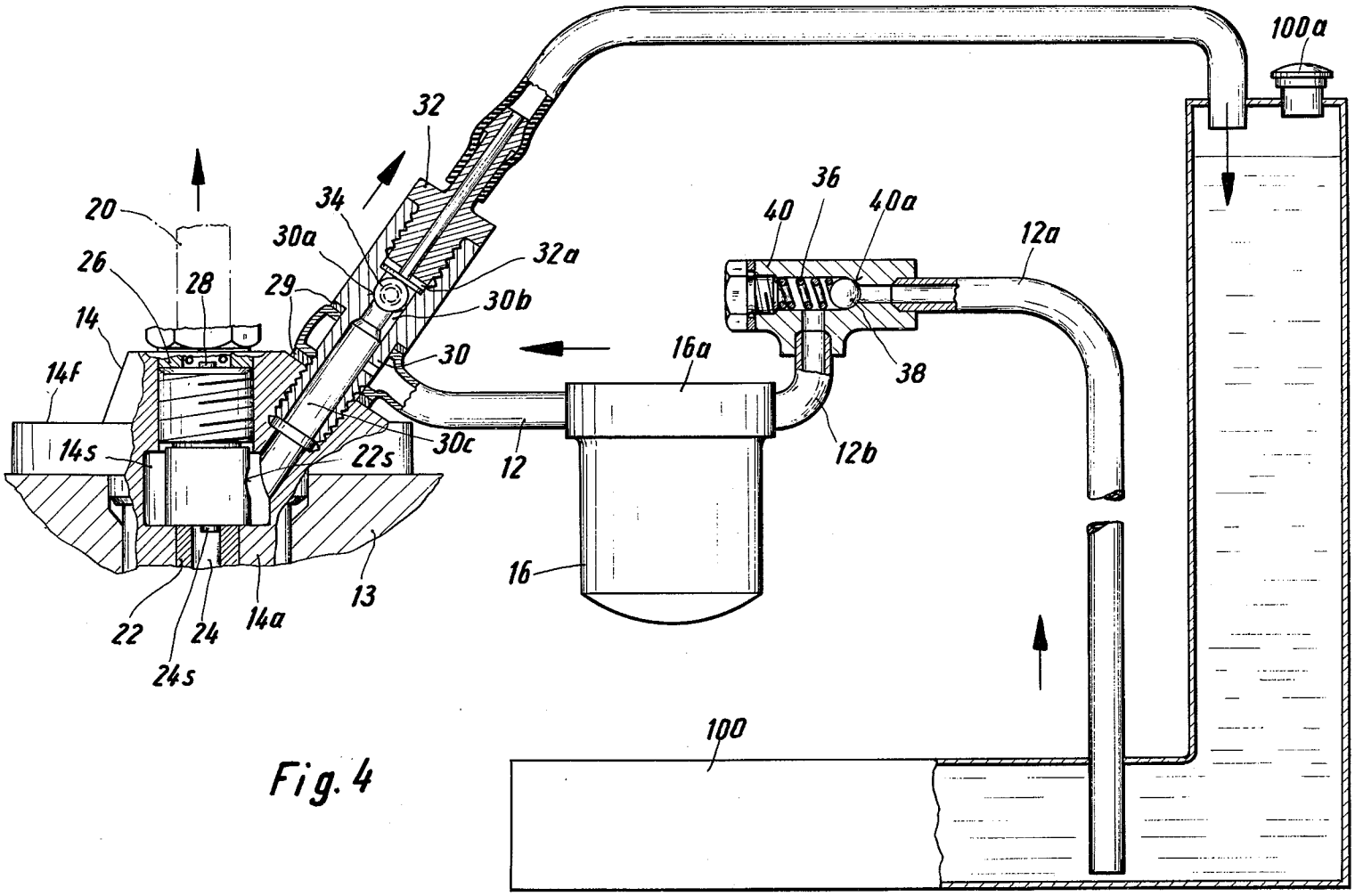
FIG. 4 is an alternative construction of the injection system.

FIG. 4 illustrates another form of construction, in which the tank 100, which for example is provided directly on the internal combustion engine, is arranged so that the lowest part thereof is disposed below the injection pump 14, but its upper part is in contrast somewhat above the valve 34 in the return flow conduit 18. An arrangement of this character has the advantage that it enables the volume of tank 100 to be substantially increased without the dimensional size of the engine being increased.

In the arrangement illustrated in FIG. 4, the injection pump 14 and the conduits 12, 12*a* and 18, as well as the valves 38 and 34, are used in the same way as in the first embodiment illustrated in FIGS. 1 and 2. For this reason, the operation of the pump 14 as a fuel delivery pump, as there described, does not need to be repeated here. It only remains to point out that the valve 34 is slightly permeable to liquid at 30*b*. This condition of the valve offers the advantage that no column of fuel can be set up in the riser part of the return flow conduit 18, such as would be possible if, for example, the valves were fully closed and there was an inadvertent idle movement of fuel from the tank 10 and the suction conduit 12,12*a*. Thus, fuel could escape from the return flow conduit 18 into the internal part of the system through the valve 34 open at 30*b*. If the tank 100 runs empty, the conduit 18 is also empty and by filling the tank 100 at its filling stopper 100*a*, the system will be filled with fuel and the venting thereof will be performed at the same time through conduit 18. Thus, the FIG. 4 construction also provides an automatic venting procedure, even though an auxiliary pump 46 is not here provided.

Finally, it is pointed out that the invention is not limited to the embodiments thereof which have been described. Thus, for example, the auxiliary pump could be in the form of a diaphragm pump with flap valves. In every arrangement, however, valves used in accordance with the invention will prevent the oscillation of the fuel column in the suction conduit and by this means enable the injection pump to also act as a fuel delivery pump.

Although particular preferred embodiments of the invention have been disclosed in detail for illustrative purposes, it will be recognized that variations or modifications of the disclosed apparatus, including the rearrangement of part, lies within the scope of the present invention.

The embodiments of the invention in which an exclusive property or privilege is claimed are defined as follows:

1. In an injection internal combustion engine having at least one fuel injection pump which is connected to the fuel supply tank through a suction conduit having a first non-return valve connected in circuit therewith, and in which fuel in excess of that used in an injection is conducted back to the supply tank through a return flow conduit separate from said suction conduit and likewise including a second non-return valve therein, the improvement comprising wherein the lowermost part of said fuel supply tank and an outlet therefrom are physically located below said fuel injection pump, said first non-return valve is a fully-closing non-return valve connected in the suction conduit, said second non-return valve being connected in said return flow conduit and, when said second non-return valve is in its seated position, permits a small flow of fuel between the return flow conduit and said fuel injection pump, said fuel injection pump being the sole means for drawing fuel from said fuel supply tank whereby during operation of said injection internal combustion engine said fuel injection pump functions both as (1) a suction pump drawing fuel from said fuel supply tank and as (2) said fuel injection pump for injecting a quantity of fuel to said injection internal combustion engine.

2. The improvement in an injection internal combustion engine according to claim 1 in which a manually operable auxiliary pump is provided in the suction conduit for filling the empty conduit system of said fuel injection pump with fuel before said injection internal combustion engine is in operation, said first non-return valve being mounted in said auxiliary pump and associated with said suction conduit.

3. The improvement in an injection internal combustion engine according to claim 2, wherein at least one of said check valves functions an operating valve of said auxiliary pump.

4. The improvement in an injection internal combustion engine according to claim 3 having a fuel filter arranged in said suction conduit wherein said first non-return valve, the auxiliary pump and the filter are combined into one constructional unit.

5. The improvement in an injection internal combustion engine according to claim 1, in which at least the filling part of said supply tank is disposed at a higher level than said injection pump, and wherein said first non-return valve provided in said return flow conduit is arranged in such a way that it is disposed slightly below the filling opening of said supply tank.

6. The improvement in an injection internal combustion engine according to claim 2, wherein said first non-return valve comprises a pair of check valves, one being located in the intake to said auxiliary pump, the other being in the outlet from said auxiliary pump, both of said check valves being biased to open upon the occurrence of a suction pressure in said suction conduit between said auxiliary pump and said fuel injection pump.

* * * * *

UNITED STATES PATENT OFFICE

CERTIFICATE OF CORRECTION

Patent No. 3 946 712 Dated March 30, 1976

Inventor(s) Gottfried Hatz and Heinz Eibl

It is certified that error appears in the above-identified patent and that said Letters Patent are hereby corrected as shown below:

In the name of the Assignee; please change "Motorengabrik" to ---Motorenfabrik---.

Signed and Sealed this

Seventh Day of September 1976

[SEAL]

*Attest:*

RUTH C. MASON
*Attesting Officer*

C. MARSHALL DANN
*Commissioner of Patents and Trademarks*